United States Patent [19]

Konrad et al.

[11] 4,269,207

[45] May 26, 1981

[54] COMBINED TOOTHBRUSH-TOOTHPASTE CONTAINER

[76] Inventors: Czeslaw Konrad; Janina Konrad, both of 2687 Neibel, Hamtramck, Mich. 48212

[21] Appl. No.: 107,642

[22] Filed: Dec. 27, 1979

[51] Int. Cl.[3] ..... A45D 44/18

[52] U.S. Cl. ..... 132/84 B

[58] Field of Search ..... 132/112-114; 401/171-175

[56] References Cited

U.S. PATENT DOCUMENTS

| | | | |
|---|---|---|---|
| 1,374,330 | 4/1921 | Stevenson | 132/84 B |
| 1,434,844 | 11/1922 | Reinholz | 132/113 |
| 1,852,617 | 4/1932 | Lamothe | 132/113 |
| 1,953,296 | 4/1934 | Gleeson | 401/175 |
| 2,172,624 | 9/1939 | Robert | 132/84 R |
| 2,630,812 | 3/1953 | Dendy | 401/171 X |
| 3,995,648 | 12/1976 | Kuryla | 132/84 B |

*Primary Examiner*—G. E. McNeill

*Attorney, Agent, or Firm*—Burns, Doane, Swecker & Mathis

[57] ABSTRACT

A toothbrush is detachably connected to a toothpaste container. The container comprises a plastic housing containing a rigid piston which is manually actuated to express toothpaste from the container, through a valved passage in the brush, and into the bristles. When the container is depleted of toothpaste, the container is detached from the brush and replaced by a new container after a plug in the latter is removed.

7 Claims, 6 Drawing Figures

COMBINED TOOTHBRUSH-TOOTHPASTE CONTAINER

BACKGROUND AND OBJECTS OF THE INVENTION

The present invention relates to a toothbrush.

Traditionally, teeth are cleaned by means of a brush onto which is applied paste from a separate toothpaste container. Proposals have heretofore been made for interconnecting a brush with a paste-containing container, whereby paste is ejected from the container, through a passage in the brush, and onto the bristles. In this regard, attention is directed to U.S. Pat. No. 1,902,859, issued on Mar. 28, 1933 to Joseph, U.S. Pat. No. 1,905,960 issued on Apr. 25, 1933 to DePhillipps, U.S. Pat. No. 2,978,722 issued on Apr. 11, 1961 to Kusakabe, and French Pat. No. 2,262,934 issued in 1975.

It has been proposed, for example, to eject the toothpaste by means of a manually displaceable piston mounted in the container. Also, it has been proposed to provide a manually actuable valve at the brush so that the connecting passage may be closed after ejection of the toothpaste (e.g., see the above-mentioned French patent). In all of the above-referenced patents, it is anticipated that after the paste has been consumed, the container is to be recharged with a fresh supply of paste by transferring same from a standard collapsible toothpaste tube into the container at a location behind the brush, or through an opening made accessible by removing the brush. Either operation is potentially messy and unsanitary. In some cases, the standard toothpaste tube is intended to be threadedly connected to the container during the transfer of toothpaste, with the pressure of the newly injected paste moving the piston back to an initial position; however, the expected resistance to such movement may cause the relatively weak standard toothpaste tube to burst as a result of a pressure build-up therein.

Besides involving the above-described disadvantages, previous proposals perpetuate the existence of collapsible toothpaste tubes which contain lead and/or aluminum substances which must be carefully isolated from the paste. Thus, the use of such tubes increases the overall expense associated with oral hygiene.

It is, therefore, an object of the present invention to provide a combination toothbrush-paste container which is sanitary, easily replenished and not dependent upon pliable toothpaste tubes.

SUMMARY OF THE INVENTION

These objects are achieved by a disposable toothpaste container for use with a toothbrush of the type comprising a stem, a bristle-carrying head formed integrally of plastic with the stem, a channel extending through the stem and head and opening into the bristle region by means of an outlet opening in the head, and a manually actuable valve movably mounted in the channel for selectively communicating the channel with the outlet opening, the container comprises a plastic cylindrical housing forming a toothpaste-containing chamber therein. The housing is connectible with the stem and includes an outlet aperture at a front end thereof. A threaded pin extends generally axially within the chamber. A piston is threadedly connected to the pin and is disposed in contact with an inner wall of the housing between the toothpaste and a rear wall of the housing. A rotary wheel is located externally of the housing adjacent the rear wall and is connected to the threaded pin such that rotation of the wheel produces axial displacement of the piston to express toothpaste through the outlet aperture.

The container may initially be separate from the brush and contain a removable plug disposed within its outlet aperture. The container can be attached to the brush after the plug is removed. When the container is depleted of toothpaste, an identical replacement container is connected to the brush.

THE DRAWING

Preferred embodiments of the invention are described in detail in the following description on the basis of the accompanying drawing in which.

DETAILED DESCRIPTION OF A PREFERRED EMBODIMENT OF THE INVENTION

Figures 1, 2, 3, 4, 5, 6:
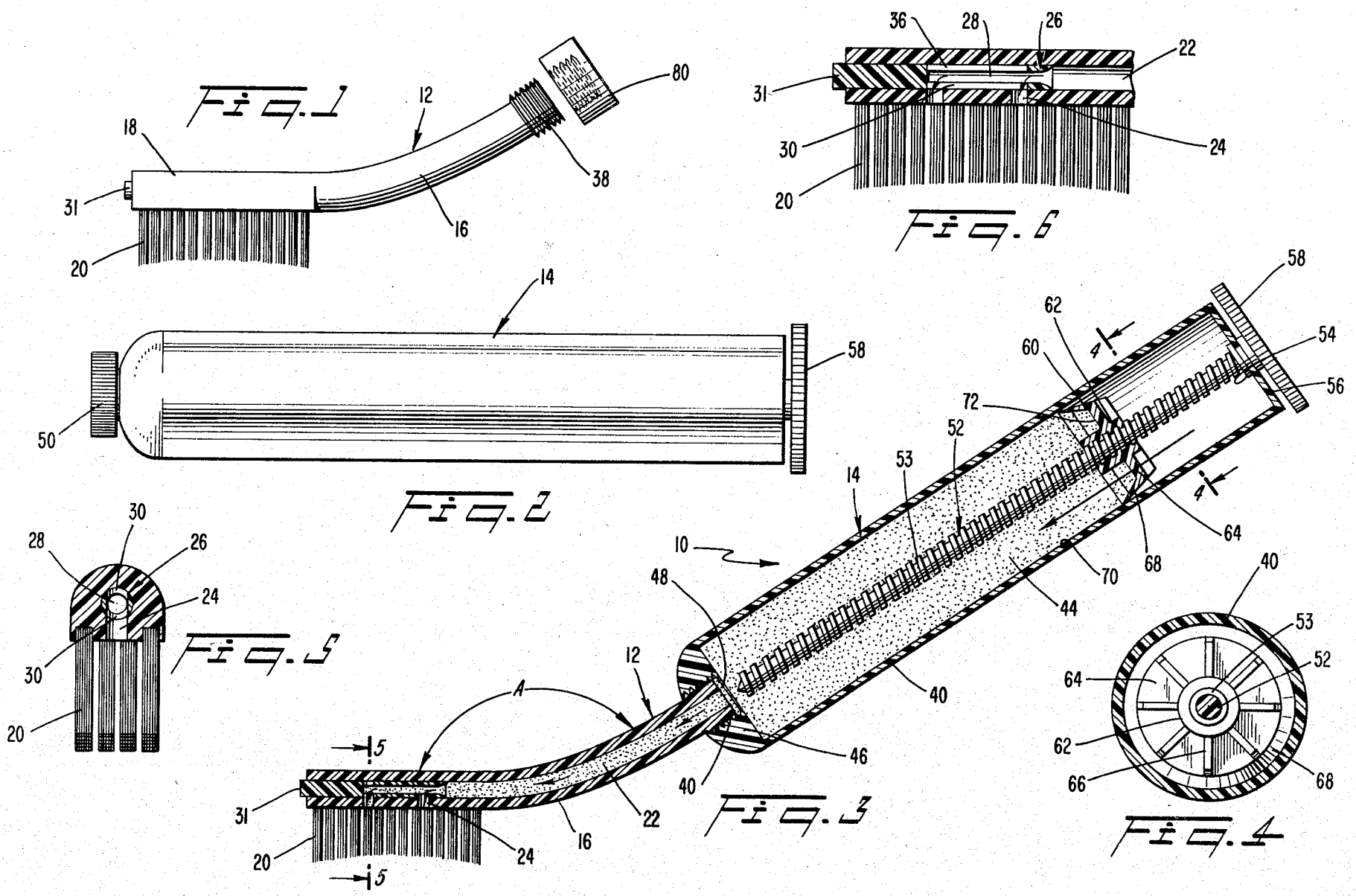
FIG. 1 is a side elevational view of a brush section of a toothbrush assembly according to the present invention.
FIG. 2 is a side elevational view of a replacement toothpaste container section of the toothbrush assembly, which has a removably plug.
FIG. 3 is a longitudinal sectional view of attached brush and container sections.
FIG. 4 is a cross-sectional view through the container section taken along line 4—4 in FIG. 3.
FIG. 5 is a cross-sectional view through the brush section taken along line 5—5 in FIG. 3.
FIG. 6 is a longitudinal sectional view of a brush section having a modified valve therein.

A combination toothbrush-toothpaste container unit 10 according to the present invention (FIG. 3) comprises a brush section 12 and a replaceable container section 14. The brush section 12 comprises a tubular stem 16 and a head 18 at one end thereof. The head 18 carries rows of bristles 20. Extending through the stem and head is a channel 22 which communicates via openings 24 in the head 18 with the bristle area.

At the rear end of the stem 16, external screw threads 38 are provided which are adapted to mate with internal screw threads 40 in the container 14.

The container 14 is a disposable element, intended for one-time usage. The container comprises a relatively rigid cylindrical housing 42 forming a toothpaste-containing chamber 44 therein. The aforementioned internal threads 40 are provided in a front end wall 46 of the housing and around an outlet aperture 48 which communicates with the chamber 44. Prior to attachment of the container section 14 to the brush section 12, the aperture 48 is closed-off by a removable threaded plug 50.

Rotatably mounted to the housing 40 is a threaded pin 52 which includes helical threads 53 and extends axially through the housing 40. The pin 52 projects through a brushing 54 in a rear wall 56 of the housing, and carries a knurled wheel 58. The wheel 58 is disposed externally of the housing and is manually rotatable.

A piston 60 is displaceably carried by the threaded pin 52 by means of a threaded hub 62, whereby rotation of the pin 52 produces axial displacement of the piston 60 within the chamber 44. The piston 60 includes a rigid body portion 64 comprising a circular disk reinforced by radial ribs 66, and a flexible annular outer edge 68 whose outer end is in pressing contact with the internal wall 70 of the housing 40. This annular edge 68 is integral with the disk 64 and of less thickness. Preferably, the edge 68 has a progressively narrowing cross-section toward the housing wall 70. In its free state, the edge may be made of slightly greater diameter than that of the internal wall 70 of the housing whereby the edge is slightly compressed when positioned within the housing 40. In this fashion, the edge creates a relatively tight seal against the housing wall 70 to prevent the leakage of toothpaste therepast.

When the pin 52 is rotated, the piston 60 is frictionally held against rotation by contact between the edge 68 and the housing wall 70 and by contact between the front surface 72 of the disk and toothpaste remaining in the container. Accordingly, the piston is constrained to travel longitudinally to force toothpaste through the channel 22 and valve 26 and into the bristle area via the openings 24.

The brush section 12 and the container section 14, including the stem 16, head 18, valve 26, pin 52, wheel 58, piston 60 and housing 40, are preferably formed of a plastic material.

The brush and container sections 12, 14 can be marketed as a connected unit, with additional container sections 14, sealed by the plug 50, being independently available as a replacement for the original container section.

To dispense toothpaste, the valve 26 is turned by rotating a protruding stem 31 to align the ports 30 in the cylindrical wall 36 with the openings 24. Thereafter, the pin 52 is manually rotated, via the wheel 58, to axially advance the piston 60 and thereby express a desired amount of toothpaste through the channel 22, into the brush section 12, and outwardly from the axial passageway 28 in the valve 26 via the valve ports 30 and the openings 24. Thereafter, the valve 26 is closed to isolate toothpaste within the channel 22 from the bristle area during a subsequent tooth brushing activity.

When the chamber 44 has been depleted of toothpaste, the spent container 14 is unscrewed from the brush section 12 and a new replacement container is threadedly secured to the brush section after removal of the container plug 50. The spent container is simply discarded.

If desired, the channel 22 of the brush section 12 can be cleaned when the brush section is detached from the container section 14, since the rear end of the channel 22 is exposed to receive a stream of water, for example. The valve 26 may be pulled from the forward end of the head to be cleaned, as well since the valve 26 is preferably retained in the channel 22 by friction.

It may be desirable to provide a cap 80 which can be screwed onto the threads 38 of the brush section to maintain the brush section sanitary when not attached to the toothpaste section, as for example before purchase or when the sections are detached for travel.

It will be appreciated that the brush section 12, its connected container section 14, and the replacement container sections form a toothbrushing system which eliminates the need for collapsible toothpaste tubes since throw-away container sections are employed. Moreover, no messy or unsanitary recharging operations are required. The container components are formed of plastic and thus pose no hazard when in contact with the toothpaste. Moreover, such plastic container sections are inexpensively fabricated and thus may be economically discarded and replaced.

Although the invention has been described in connection with a preferred embodiment thereof, it will be appreciated by those skilled in the art that additions, modifications, substitutions and deletions not specifically described may be made without departing from the spirit and scope of the invention as defined in the appended claims.

What is claimed is:

1. A disposable toothpaste container for use with a toothbrush of the type comprising a stem, a bristle-carrying head formed integrally of plastic with said stem, a channel extending through said stem and head and opening into the region of said bristles by means of at least one outlet opening in said head, and a manually actuable valve rotatably mounted in said channel with said at least one outlet opening, said valve being frictionally held within the channel such that the valve is easily removable from a forward end of the channel, said container comprising:

a plastic cylindrical housing forming a toothpaste-containing chamber therein, said housing being connectable with said stem and including an outlet aperture at a front thereof, a threaded pin extending generally axially within said chamber, a piston threadedly connected to said pin and disposed in contact with an inner wall of said housing between the toothpaste and a rear wall of said housing, said piston comprises a flat rigid disk portion and a sealing edge disposed along the peripheral edge of said disk and inclined toward said front end of said housing, said edge being tapered toward said inner wall of said housing, a rotary wall located externally of said housing adjacent said rear wall and connected to said threaded pin such that rotation of said wheel produces axial displacement of said piston to express toothpaste through said outlet aperture, and a removable plug disposed within said outlet aperture.

2. Apparatus according to claim 1, wherein said outlet aperture is threaded to threadedly receive a threaded end of said stem, said plug being threadedly secured in said outlet aperture.

3. Apparatus according to claim 1, wherein said threaded pin, piston and wheel are formed of plastic.

4. A toothbrushing system comprising:

a brush section comprising:

a stem;

a bristle-carrying head formed integrally of plastic with said stem;

a channel extending through said stem and head and opening into the bristle region by means of at least one outlet opening in said head; and a manually actuable valve rotatably mounted in said channel for selectively communicating said channel with said at least one outlet opening, said valve being frictionally held within the channel such that the valve is easily removable from a forward end of the channel, and a disposable container section detachably coupled to said stem at a rear end thereof opposite said head, said container comprising:

a plastic disposable housing forming a toothpaste-containing chamber therein, said housing including means releasably connecting said housing to said stem, and an outlet aperture communicating with said channel, a plastic threaded pin extending axially within said chamber, a piston threadedly connected to said pin and disposed in contact with an inner wall of said housing between the toothpaste and a rear wall of said housing, said piston comprising a flat rigid disk portion and a sealing edge disposed along the peripheral edge of said disk and inclined toward said front end of said housing, said edge being tapered toward said inner wall of said housing, a plastic rotary wheel located externally of said housing adjacent said rear wall and connected to said pin such that rotation of said wheel produces axial displacement of said piston to express toothpaste through said channel, said outlet opening, and into the bristle region, and a replacement container section separate from said brush section and being identical to said first-named container section except having a removable plug closing-off the outlet aperture of said replacement container, said plug being removable to enable said replacement container to be substituted for said first-named container section when the latter is depleted of toothpaste.

5. Apparatus according to claim 4, wherein said outlet aperture of said replacement container is threaded to threadedly receive a threaded end of said stem, said plug being threadedly secured in said outlet aperture.

6. Apparatus according to claim 4, wherein said stem is inclined relative to said head to form an included angle therebetween, the bristles projecting from a side of said head facing generally away from said angle.

7. Apparatus according to claim 4 wherein said stem is angled relative to said head, forming an included angle of about 155° therebetween.

* * * * *